US008640777B2

(12) United States Patent
Kobata et al.

(10) Patent No.: US 8,640,777 B2
(45) Date of Patent: Feb. 4, 2014

(54) EXPANDABLE ANCHORING MECHANISM

(75) Inventors: Francisco Kazuo Kobata, Sao Paulo (BR); Lucas Antonio Perrucci, Sao Paulo (BR); Deivis Alves Verdan, Sao Caetano do Sul (BR)

(73) Assignee: Vetco Gray Inc., Houston, TX (US)

( * ) Notice: Subject to any disclaimer, the term of this patent is extended or adjusted under 35 U.S.C. 154(b) by 149 days.

(21) Appl. No.: 13/109,783

(22) Filed: May 17, 2011

(65) Prior Publication Data

US 2012/0097399 A1 Apr. 26, 2012

Related U.S. Application Data

(60) Provisional application No. 61/406,191, filed on Oct. 25, 2010.

(51) Int. Cl.
*E21B 19/00* (2006.01)
*E21B 33/035* (2006.01)

(52) U.S. Cl.
USPC ..... 166/348; 166/368

(58) Field of Classification Search
USPC ..... 166/348, 368, 367, 382
See application file for complete search history.

(56) References Cited

U.S. PATENT DOCUMENTS

| | | | | |
|---|---|---|---|---|
| 4,900,041 | A * | 2/1990 | Hopkins et al. | 277/328 |
| 4,949,786 | A * | 8/1990 | Eckert et al. | 166/208 |
| 5,174,376 | A * | 12/1992 | Singeetham | 166/208 |
| 7,073,591 | B2 | 7/2006 | Massie et al. | |
| 7,861,789 | B2 * | 1/2011 | Nelson | 166/348 |
| 8,276,671 | B2 * | 10/2012 | Neto et al. | 166/348 |
| 2011/0240306 | A1 * | 10/2011 | Neto | 166/348 |

FOREIGN PATENT DOCUMENTS

EP 2374990 A2 10/2011

* cited by examiner

*Primary Examiner* — Matthew Buck
*Assistant Examiner* — James Sayre
(74) *Attorney, Agent, or Firm* — Bracewell & Giuliani LLP

(57) ABSTRACT

A bridging hanger with an expandable anchoring mechanism lands on a casing hanger in a subsea wellhead and actuates to anchor to the casing hanger. The anchoring mechanism includes a tubular main body, and a tubular sealing sleeve. The tubular sealing sleeve is coaxial with and mounted on an exterior diameter portion of the tubular main body. The body is moveable from an upper run-in position to a lower set position relative to the sealing sleeve. The anchoring mechanism also includes a first and second locking ring, both carried by the sealing sleeve. The first locking ring engages a profile within an interior of the casing hanger in response to movement of the main body from the run-in to the set position. The second locking ring locks the tubular main body in the set position in response to movement of the main body from the run-in to the set position.

17 Claims, 12 Drawing Sheets

EXPANDABLE ANCHORING MECHANISM

This application claims priority to and the benefit of U.S. Provisional Application No. 61/406,191, filed on Oct. 25, 2010, entitled "Expandable Anchoring Mechanism," which application is hereby incorporated herein by reference.

BACKGROUND OF THE INVENTION

1. Field of the Invention

This invention relates in general to bridging hanger support within a wellhead assembly, and more particularly to a structure to increase bridging hanger seal capacities.

2. Brief Description of Related Art

A subsea well assembly includes a wellhead housing that is secured to a large diameter conductor pipe extending to a first depth in the well. After drilling to a second depth through the conductor pipe, a string of casing is lowered into the well and suspended in the wellhead housing by a casing hanger. A packoff seals between an outer diameter portion of the casing hanger and the bore of the wellhead housing. Some wells have two or more strings of casing, each supported by a casing hanger in the wellhead housing.

In one type of completion, a string of production tubing is lowered into the last string of casing. A tubing hanger lands and seals to the upper casing hanger. The production tubing string is suspended from the tubing hanger and the well is then produced through the tubing. Prior to running the tubing and the tubing hanger, the operator will pressure test the upper casing hanger packoff. The packoff may be unable to pass the pressure test, possibly due to damage on the interior wall of the wellhead housing. If so, one remedy is to install an emergency or bridging hanger in the wellhead housing. The bridging hanger does not support a string of casing, but has an interior profile that is normally the same as the profile in the upper casing hanger. The operator lands and seals the lower portion of the bridging hanger to the casing hanger. The operator installs a packoff between the upper exterior portion of the bridging hanger and the wellhead housing above the casing hanger. The operator then runs the tubing and lands and seals the tubing hanger in the bridging hanger.

As wellbore depths have increased, pressures within the wellbore have increased, exerting increasingly higher loads against the hangers suspending casing and liner strings. In situations where bridging hangers are needed to supplement a casing hanger packoff, these pressures may be larger than the maximum pressure ratings of the bridging hangers. Consequently, after landing and setting the bridging hanger, the wellbore pressure may cause the packoff sealing the bridging hanger to the wellbore to fail, making the bridging hanger unsuitable for landing of a subsequent tubing hanger. Therefore, there is a need for an apparatus and method to increase the pressure ratings of the bridging hanger and its corresponding seals.

SUMMARY OF THE INVENTION

These and other problems are generally solved or circumvented, and technical advantages are generally achieved, by preferred embodiments of the present invention that provide an expandable anchoring system, and a method for using the same.

In accordance with an embodiment of the present invention, a bridging hanger for securing to a subsea casing hanger is disclosed. The bridging hanger includes a tubular main body, and a tubular sealing sleeve. The tubular sealing sleeve is coaxial with and mounted on an exterior diameter portion of the tubular main body. The tubular main body is moveable from an upper run-in position to a lower set position relative to the sealing sleeve. The bridging hanger includes a first locking ring carried by the sealing sleeve and adapted to engage a profile within an interior of the casing hanger in response to movement of the main body from the run-in to the set position. The bridging hanger also includes a second locking ring carried by the sealing sleeve to lock the tubular main body in the set position in response to movement of the main body from the run-in to the set position.

In accordance with another embodiment of the present invention, a subsea wellhead assembly is disclosed. The subsea wellhead assembly includes a casing hanger, a bridging hanger, and an anchoring mechanism. The casing hanger is adapted to be landed and set in a wellhead. The bridging hanger is landed and set in the wellhead in engagement with the casing hanger. The anchoring mechanism is incorporated with the bridging hanger that lands on the casing hanger. The anchoring mechanism actuates in response to weight applied to the bridging hanger to lock the bridging hanger to the casing hanger.

In accordance with yet another embodiment of the present invention, a method for anchoring a bridging hanger to a casing hanger disposed in a subsea wellhead is disclosed. The method mounts an anchoring mechanism assembly to a main body of a bridging hanger. The method then lands the anchoring mechanism and bridging hanger on the casing hanger, and then actuates the anchoring mechanism by applying weight to the bridging hanger assembly to lock the bridging hanger to the casing hanger.

An advantage of a preferred embodiment is that the pressure capacity of a bridging hanger may be increased. This is accomplished without the need for a lock down sleeve or hanger that would require an additional two trips downhole to land and set. Thus, the current embodiments reduce the total number of trips necessary to increase the pressure capacity of the bridging hanger to a level needed within the wellbore.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, casing hanger and casing operation, construction, installation, and the like have been omitted inasmuch as such details are not considered necessary to obtain a complete understanding of the present invention, and are considered to be within the skills of persons skilled in the relevant art.

Figure 1:
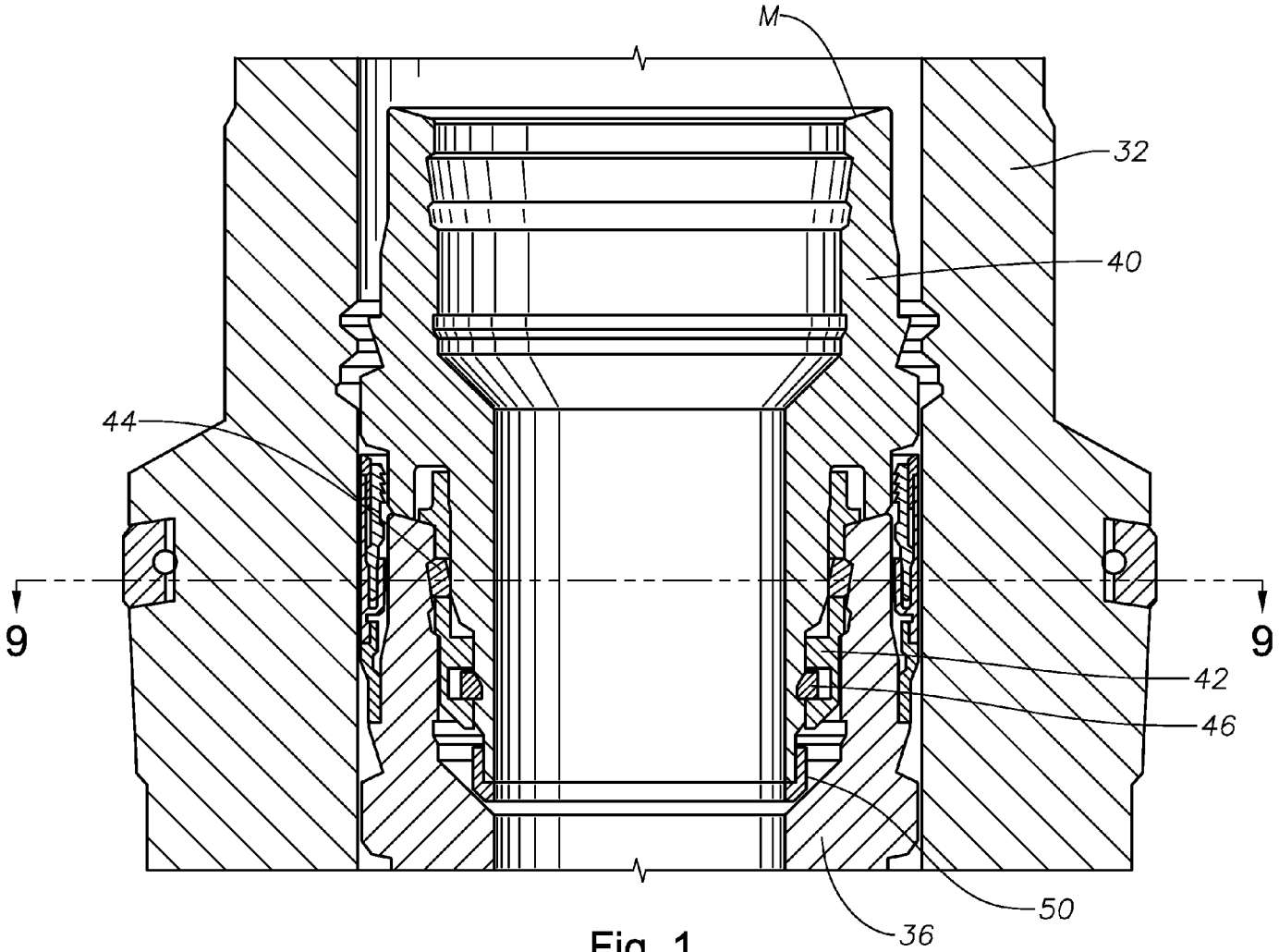
FIG. 1 is a vertical cross-sectional view of a portion of a wellhead assembly with an expandable anchoring mechanism installed according to the present invention.

Referring to FIG. 1, an anchoring mechanism M is landed and set as a component of a subsea wellhead assembly located at the sea floor. Anchoring mechanism M is installed in a casing hanger 36 in a conventional wellhead housing 32 in the subsea wellhead assembly. A string of conductor pipe (not shown) is mounted in wellhead housing 32 and extends to a first depth in a well. Casing hanger 36 is provided to secure to a string of casing (not shown), which is cemented in place. Further details of wellhead housing 32 and its connection in a subsea wellhead assembly are set forth in commonly owned U.S. Pat. No. 7,073,591, which is incorporated herein by reference.

Figure 2:
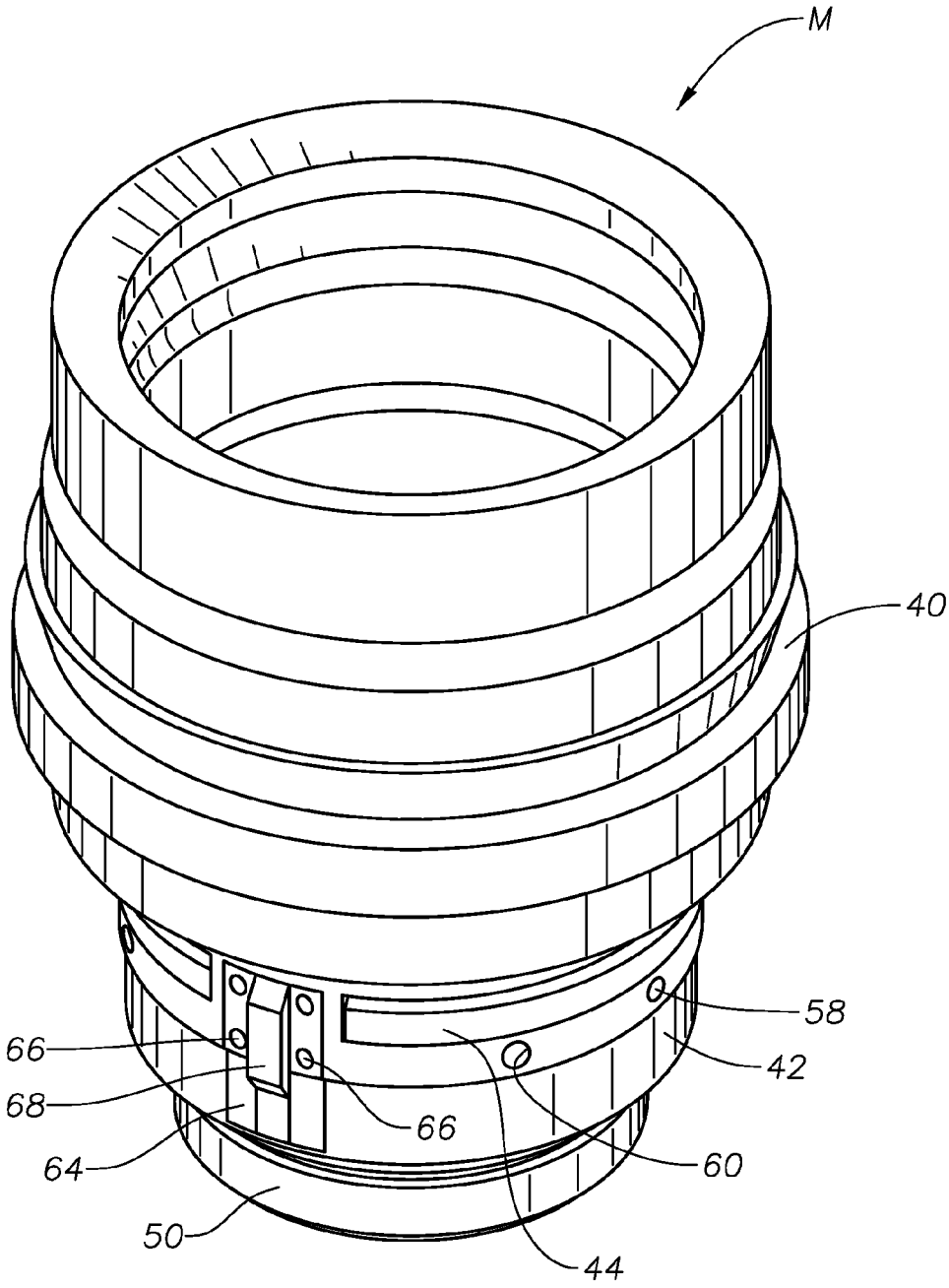
FIG. 2 is a perspective view of an expandable anchoring mechanism according to the present invention.

Referring to FIG. 2, anchoring mechanism M includes a main body 40 to which is mounted a sealing sleeve 42. Anchoring mechanism M includes a circumferentially extending C-shaped first or upper locking ring 44. Upper locking ring 44 is fitted into a circumferentially extending annular groove or slot 88 (FIG. 5) in sealing sleeve 42 adjacent arcuate cam housing slots 76 of sealing sleeve 42. Upper locking ring 44 is provided for sealing and locking between sealing sleeve 42 and casing hanger 36, as described below.

Figure 9:
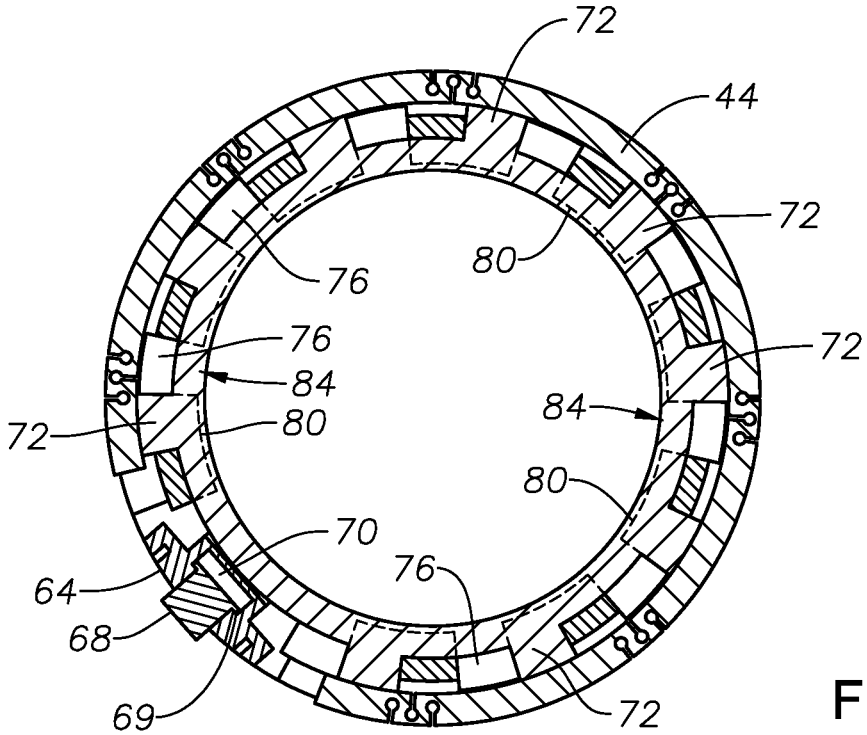
FIG. 9 is a partial cross-sectional view of the expandable anchoring mechanism taken along the lines 9-9 of FIG. 1.
Figure 10:
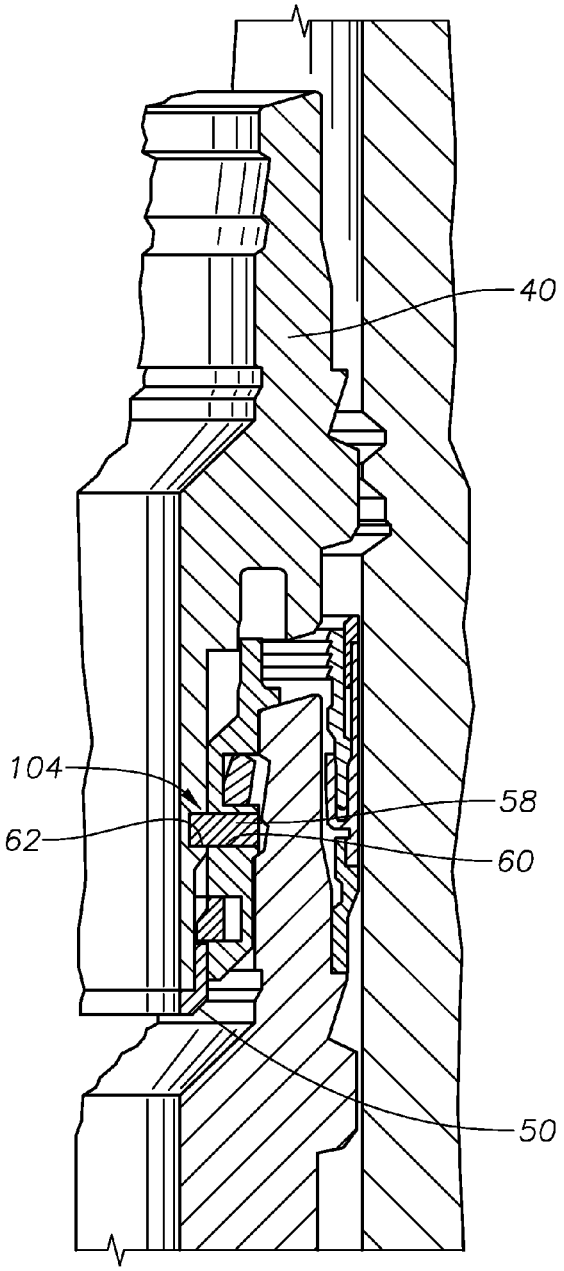
FIG. 10 is a schematic sectional view of portions of the structure of FIG. 1 illustrating the operation of the present invention.

Referring to FIG. 2, anchoring mechanism M includes a number of shear pins 58 mounted in radially extending ports or passages 60 in sealing sleeve 42. Shear pins 58 extend into radially extending sockets 62 (FIG. 10) formed in main body 40. As shown in FIG. 2, anchoring mechanism M also includes an internal anti-rotation key 64 mounted to sealing sleeve 42 by connector screws or pins 66 and an external anti-rotation key 68 secured within a retainer groove or slot 70 of internal anti-rotation key 64 as shown in FIG. 9. A cylindrical assembly nut 50 mounts to a lower end of main body 40.

Figure 3:
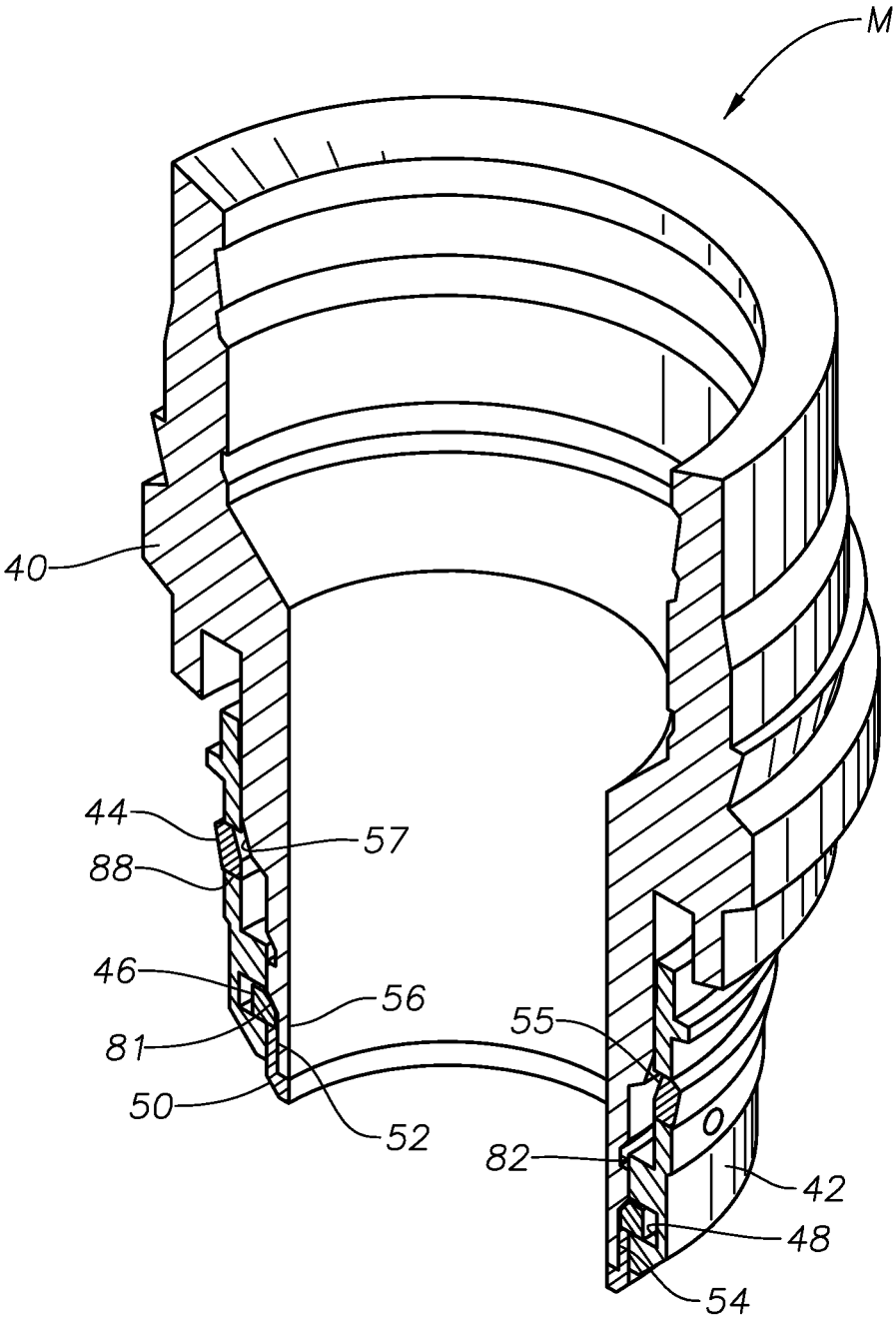
FIG. 3 is a vertical cross-sectional view of the structure of FIG. 2.
Figure 10A:
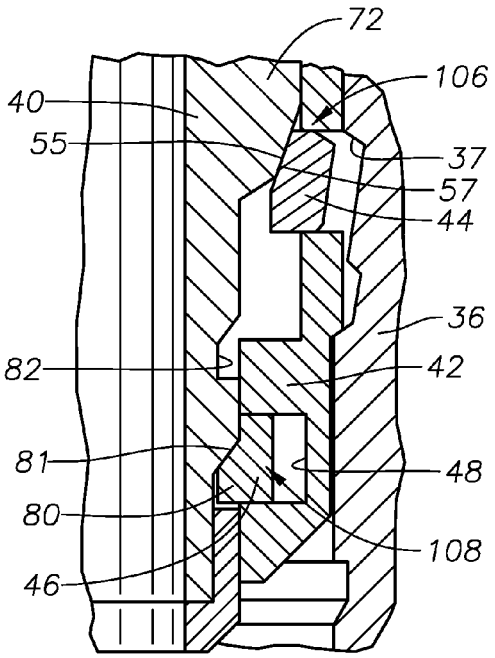
FIG. 10A is an enlarged view of a portion of the structure circled and identified by reference numeral 10A in FIG. 10.

As shown in FIG. 3, upper locking ring 44 comprises a C-ring having an exterior diameter profile adapted to match an inner diameter profile or groove 37 in casing hanger 36 (FIG. 10A). Referring to FIG. 3, upper locking ring 44 has an actuation bevel 55 on an interior diameter upper end of upper locking ring 44. Actuation bevel 55 may engage a matching bevel 57 on main body 40 to urge first or upper locking ring 44 radially outward as described below with respect to FIGS. 10 and 10A. As shown in FIG. 3, cylindrical assembly nut 50 has a threaded inner surface 52 to engage with and mount on a corresponding threaded outer surface 54 formed on a lower portion or neck 56 of main body 40 axially below sealing sleeve 42. Cylindrical assembly nut 50 may allow sealing sleeve 42 to slide axially over main body 40, as described below, while securing sealing sleeve 42 to main body 40. Anchoring mechanism M also includes a C-shaped second or lower locking ring 46 mounted in a lower locking ring annular groove 48 in an inner lower portion of sealing sleeve 42. Lower locking ring 46 will be described in more detail below with respect to FIG. 6.

Figure 4:
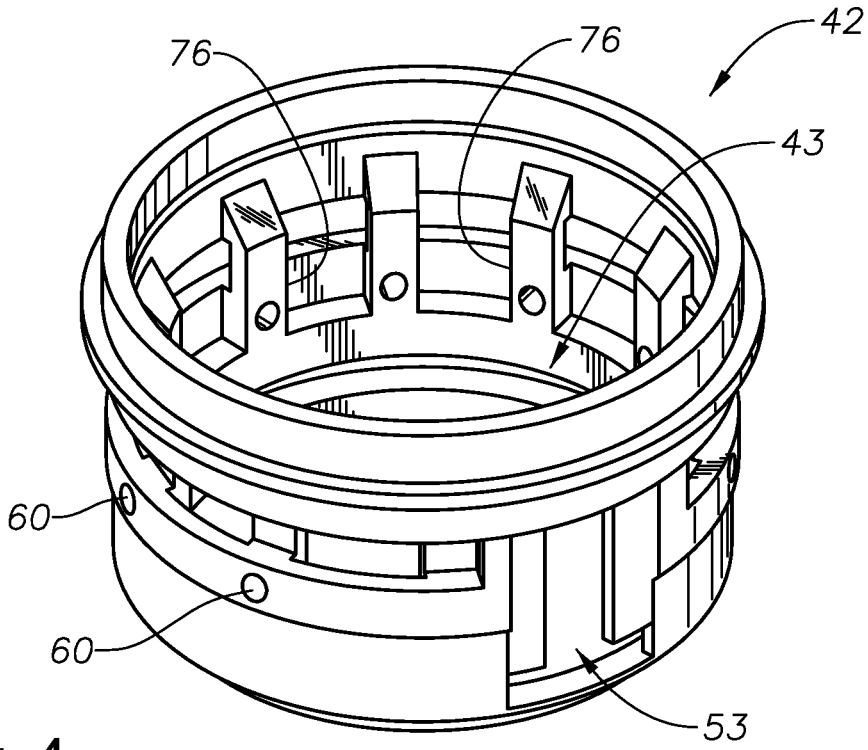
FIG. 4 is a perspective view of a sealing sleeve component of the expandable anchoring mechanism of the structure of FIG. 2.
Figure 5:
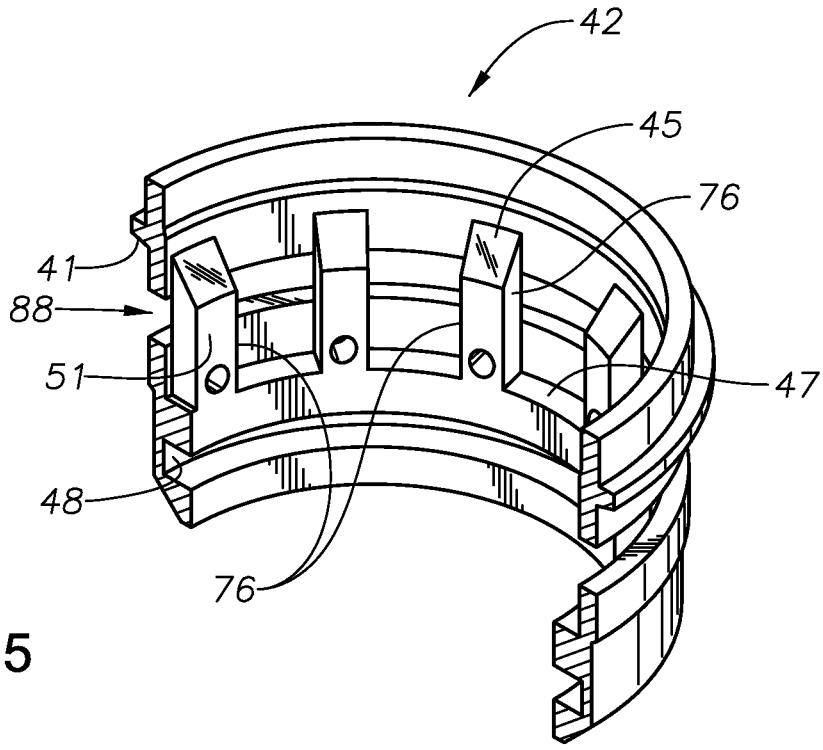
FIG. 5 is a vertical cross-sectional view of the sealing sleeve of FIG. 4.

Referring now to FIGS. 4 and 5, sealing sleeve 42 may be a tubular body defining a sealing sleeve central passage 43. Lower locking ring annular groove 48 is formed in a lower end of sealing sleeve 42 and extends from an inner diameter surface of sealing sleeve 42 radially outward. Upper locking ring annular groove 88 is formed in an upper end of sealing sleeve 42 and extends from an outer diameter surface of sealing sleeve 42 radially inward. Sealing sleeve central passage 43 has a first diameter at a lower end of sealing sleeve 42 and tapers out to a second diameter at an upper end of sealing sleeve 42 at upward facing tapered shoulder 45.

Sealing sleeve arcuate cam housing slots 76 are formed in the inner diameter portion of sealing sleeve 42 and extend axially downward from upward facing tapered shoulder 45 to land at an upward facing slot shoulder 47. Sealing sleeve ribs 51 separate each sealing sleeve arcuate cam housing slot 76 from adjacent sealing sleeve arcuate cam housing slots 76. As shown in FIG. 4, sealing sleeve 42 defines an inverse T anti-rotation opening 53 through a sidewall of sealing sleeve 42. As described in more detail below, inner and outer anti-rotation keys 64, 68 will mount to sealing sleeve 42 in anti-rotation opening 53. Ports 60 extend through sealing sleeve 42 from an exterior diameter surface of sealing sleeve 42 to sealing sleeve central passage 43. Sealing sleeve 42 also defines a downward facing shoulder 41 on an exterior diameter portion of sealing sleeve 42. Downward facing shoulder 41 may land on a rim of casing hanger 36 as described in more detail below.

Figure 6:
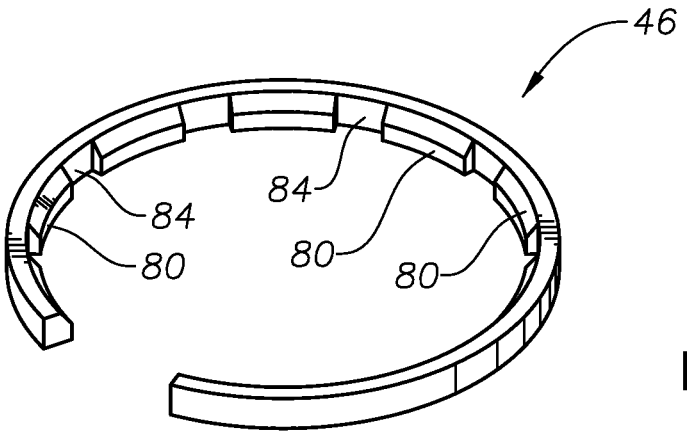
FIG. 6 is a perspective view of a lower locking ring component of the expandable anchoring mechanism of the structure of FIG. 2.

As shown in FIG. 6, lower locking ring 46 has a suitable number of radially spaced, inwardly extending locking fingers 80 formed at spaced positions about its inner surface. A set of circumferentially disposed slots 84 are present between locking fingers 80. Slots 84 are of comparable arcuate 12° dimensions to fingers 72 (FIG. 8) on main body 40 described in more detail below.

Figure 7:
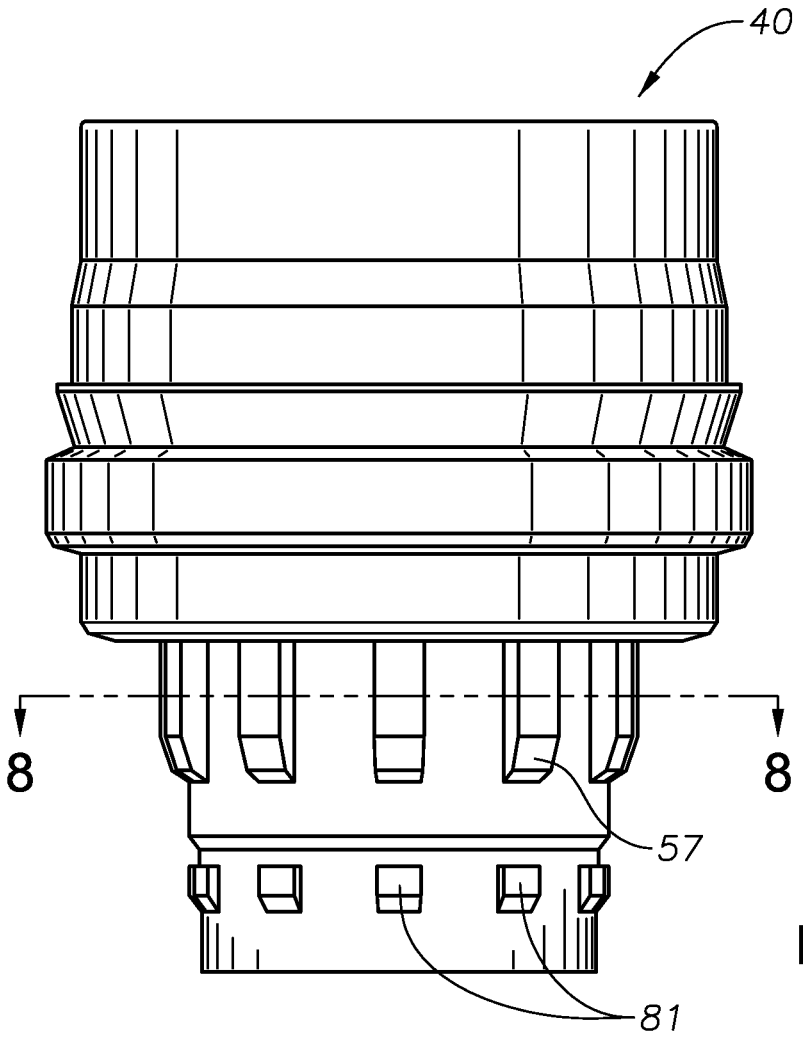
FIG. 7 is a front view of a tubular main body component of the expandable anchoring mechanism of FIG. 2.
Figure 8:
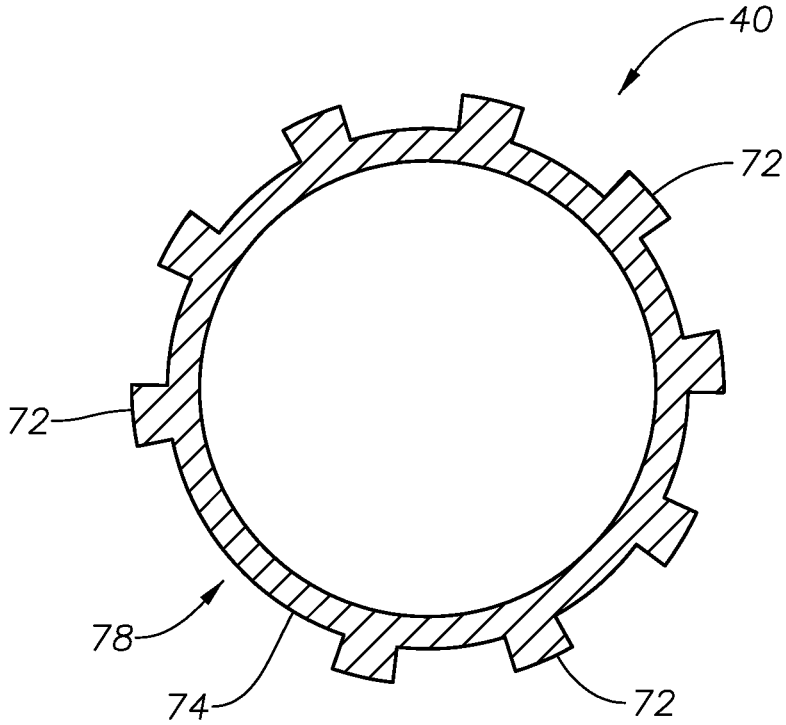
FIG. 8 is a cross-sectional view taken along the lines 8-8 of FIG. 7.

Referring now to FIGS. 7 and 8, main body 40 has a number of radially spaced outwardly extending keys or fingers 72 (FIG. 8) formed about an outer cylindrical surface 74. Fingers 72 extend as indicated in FIG. 8 an arcuate dimension of 12° and are located on the surface of main body 40. Fingers 72 are equally spaced from each other, except as indicated at 78, where a gap is provided to receive and accommodate anti-rotation keys 64 and 68 of sealing sleeve 42. As shown in FIG. 9, arcuate cam housing slots 76 of sealing sleeve 42 are formed to extend an arcuate dimension of 24°, twice the extent of fingers 72 of main body 40. Fingers 72 extend a portion of the axial length of main body 40 and include bevel 57 on lower ends of each finger 72. As described in more detail below, sealing sleeve 42 will slide over main body 40 such that fingers 72 of main body 40 will reside within a corresponding arcuate cam housing slot 76.

Referring to FIG. 7, main body 40 also includes lower locking ring actuation members 81 formed on a lower exterior portion of main body 40. Lower locking ring actuation members 81 are protrusions axially aligned with fingers 72 and having a width substantially equivalent to the width of fingers 72. In addition, the width of lower locking ring actuation members 81 is such that lower locking ring actuation members 81 may pass through slots 84 of lower locking ring 46.

During operation, when second or lower locking ring 46 engages, fingers 80 may fit into an annular recess 82 (FIGS. 3 and 12A) formed about a lower outer portion of main body 40 axially beneath fingers 72 to form a load bearing connection (FIGS. 12 and 12A) between main body 40 and sealing sleeve 42.

As shown in FIG. 9, external anti-rotation key 68 is fitted within a downwardly extending slot 70 of internal anti-rotation key 64. As shown, slot 70 of internal anti-rotation key 64 has a T-shaped radial profile with a bar of the T proximate to the inner diameter of internal anti-rotation key 64. External anti-rotation key 68 includes external anti-rotation key ribs 69 adapted to insert into the bar of the T-shaped radial profile of slot 70 of internal anti-rotation key 64. Preferably, the bar of slot 70 has a radial depth greater than the radial depth of ribs 69; thus, external anti-rotation key 68 may move between a radially inward and a radially outward position. Internal anti-rotation key 64 includes bores to receive connectors 66 that may then secure internal anti-rotation key 64 to sealing sleeve 42. External anti-rotation key 68 may be urged outwardly by a resilient force from a spring (not shown) in slot 70. External anti-rotation key 68 is engageable and moveable outwardly and inwardly in response to the resilient forces for emergency unlocking, as will be set forth below.

External anti-rotation key 68 is engaged and depressed radially inwardly by an interior surface of casing hanger 36 when anchoring mechanism M is initially landed on casing hanger 36. External anti-rotation key 68 is outwardly movable after, as will be described, to engage within a slot 86 (FIG. 15) of which several may be provided at circumferentially spaced positions formed extending longitudinally along an inner surface of casing hanger 36.

Anchoring mechanism M is assembled by first mounting the upper locking ring 44, lower locking ring 46 and anti-rotation keys 64 and 68 onto sealing sleeve 42. Upper locking ring 44 will fit into upper locking ring annular groove 88, such that a portion of actuation bevel 55 will be exposed in sealing sleeve central passage 43 at arcuate cam housing slots 76. Second or lower locking ring 46 will fit into lower locking ring annular groove 48 such that fingers 80 face sealing sleeve central passage 43. The main body 40 is then fitted into the sealing sleeve 42, with a clearance fit provided between main body 40 and sealing sleeve 42. As assembled prior to operation, bevel 57 on the lower end of each finger 72 will abut actuation bevel 55 on upper locking ring 44 through arcuate cam housing slot 76 as shown in FIG. 3. Fingers 80 of second or lower locking ring 46 will circumscribe main body 40 axially below lower locking ring actuation members 81 of main body 40 axially below annular recess 82. Slots 84 of lower locking ring 46 will align with the spaces between each finger 72 of main body 40 as shown in hidden lines in FIG. 9. Referring to FIG. 2, shear pins 58 are then inserted through the ports 60 in sealing sleeve 42 and into the sockets 62 in the main body 40. The assembly nut 50 is then mounted on the main body 40 and their threaded surfaces 52 and 54 (FIG. 3) brought into engagement such that an upper rim of cylindrical assembly nut 50 abuts a lower surface of second or lower locking ring 46, retaining sealing sleeve 42 on main body 40.

The assembled anchoring mechanism M thus takes the form of cylindrical seal sleeve 42 clearance fitted onto main body 40 so that cylindrical seal sleeve 42 is restrained against axial movement relative to main body 40 by the presence of shear pins 58. C-shaped locking rings 44 and 46 are capable of relative inward and outward radial movement with respect to the sealing sleeve 42 when subjected to external forces, but constrained against axial movement relative to sealing sleeve 42 by annular grooves 88, 48, respectively. The assembled anchoring mechanism M is available to be moved downwardly and landed in the conventional manner onto casing hanger 36 for locking in place.

Figure 11:
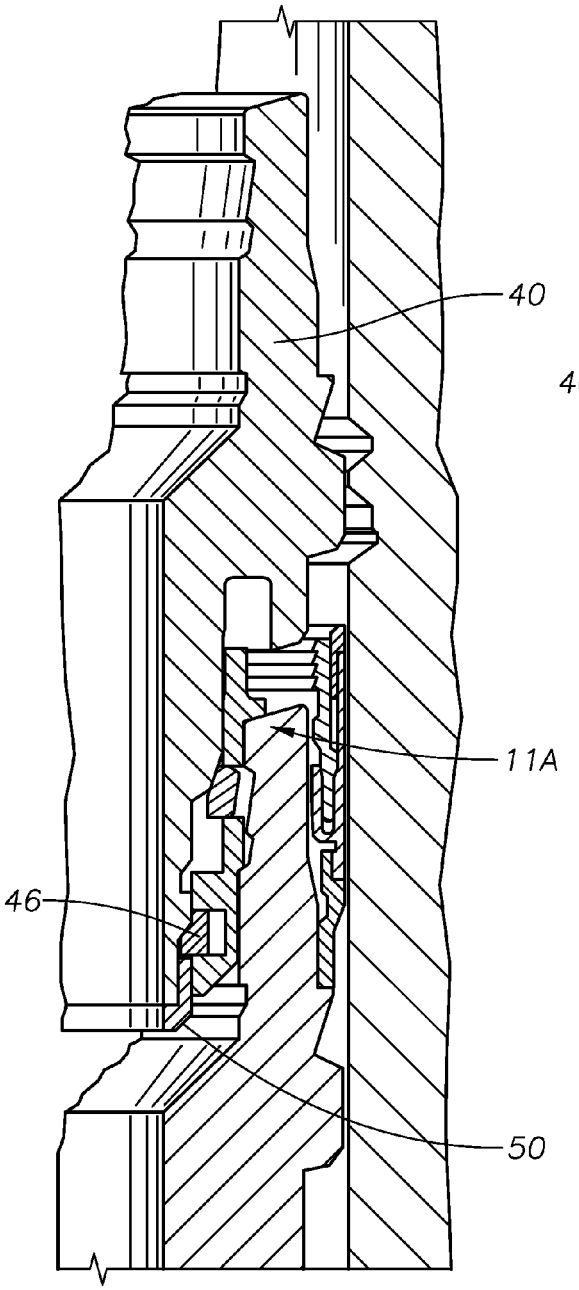
FIG. 11 is a schematic sectional view of portions of the structure of FIG. 1 illustrating the operation of the present invention.
Figure 11A:
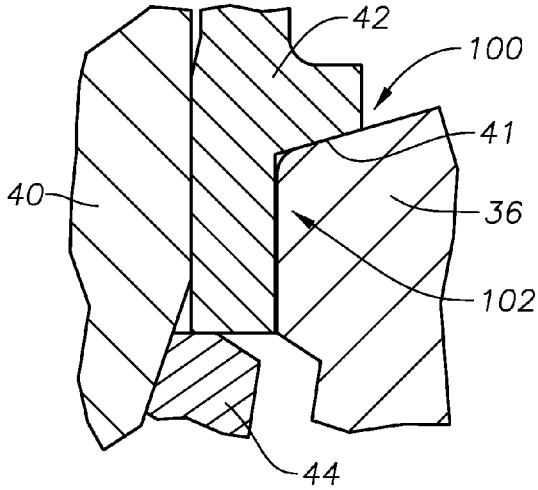
FIG. 11A is an enlarged view of a portion of the structure circled and identified by reference numeral 11A in FIG. 11.

In operation, downward facing shoulder 41 of sealing sleeve 42 lands on an upper seating surface of casing hanger 36 as illustrated in FIG. 1 and shown schematically at 100 in FIG. 11A. At the same time, an external metal-to-metal seal between surfaces of sealing sleeve 42 and casing hanger 46 is formed as shown at 102 in FIG. 11A. For this purpose, a load of a first level, such as approximately 60,000 pounds, is applied to the anchoring mechanism M to energize external metal-to-metal seal 102.

Thereafter, an additional larger load, such as approximately 80,000 pounds, is applied to anchoring mechanism M to shear shear pins 58. When shear pins 58 fracture, as shown at 104 in FIG. 10, connection between main body 40 and sealing sleeve 42 is broken, and main body 40 is provided axial freedom of movement in relation to sealing sleeve 42. Main body 40 is then capable of downward axial movement with respect to sealing sleeve 42 and casing hanger 36.

As main body 40 begins to move downwardly, both upper locking ring 44 and lower locking ring 46 are energized through the cam profile surfaces at locations 106 and 108 as shown in FIG. 10A. Bevel 57 of each finger 72 contacts actuation bevel 55 of first or upper locking ring 44. As main body 40 continues moving axially downward relative to sealing sleeve 42, bevel 57 of each finger 72 will force first or upper locking ring 44 radially outward as actuation bevel 55 slides along bevel 57. As first or upper locking ring 44 moves radially outward, it will land in a matching profile on casing hanger 36. In the illustrated embodiment, casing hanger 36 will include a downward facing shoulder 37 against which first or upper locking ring 44 will abut to prevent upward axial movement of sealing sleeve 42 relative to casing hanger 36.

Simultaneously, the matching beveled profiles of fingers 80 of second or lower locking ring 46 and lower locking ring actuation members 81 will slide past one another forcing second or lower locking ring 46 radially into annular groove 48. As main body 40 continues moving axially downward relative to sealing sleeve 42, annular recess 82 will move proximate to second or lower locking ring 46. Second or lower locking ring 46 will then move radially inward into annular recess 82 such that the beveled profile of second or lower locking ring 46 will abut main body 40 within annular recess 82.

Figure 12:
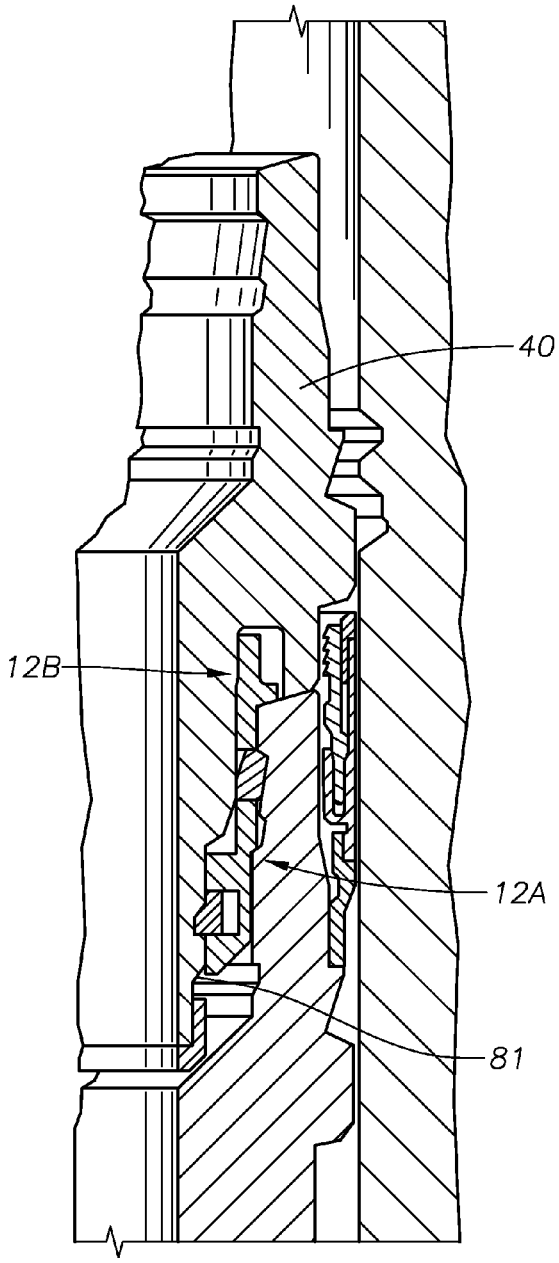
FIG. 12 is a schematic sectional view of portions of the structure of FIG. 1 illustrating the operation of the present invention.
Figure 12A:
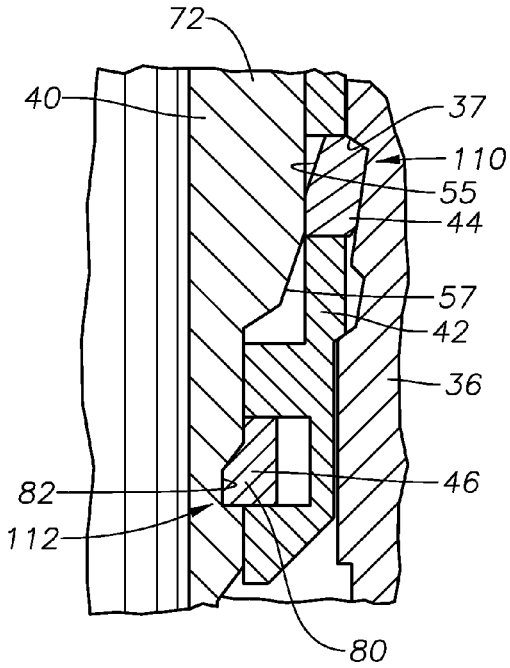
FIG. 12A is an enlarged view of a portion of the structure circled and identified by reference numeral 12A in FIG. 12.
Figure 12B:
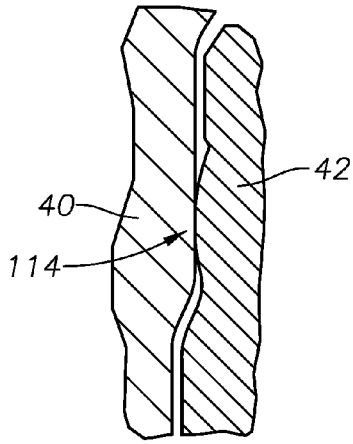
FIG. 12B is an enlarged view of a portion of the structure circled and identified by reference numeral 12B in FIG. 12.

At the end of its downward movement as shown in FIG. 12, main body 40 maintains upper locking ring 44 energized in order to pull some anchoring from casing hanger 36 as shown at 110 in FIG. 12A. Lower locking ring 46 contracts its diameter inwardly into annular recess 82 in order to set on and fit against lower locking ring actuation members 81 of main body 40 as indicated at 112 in FIG. 12A, and to thus lock sealing sleeve 42 and main body 40 together. Also, an internal metal-to-metal seal between an upper portion of sealing sleeve 42 and an inner circumferential surface of main body 40 is energized as indicated at 114 in FIG. 12B. Sealing sleeve 42 and main body 40 have then been locked into position and in metal-to-metal sealing engagement.

In order to unlock main body 40 from sealing sleeve 42 once engaged and locked together, a rotation of main body 40 in a clockwise direction of 12° is performed. This moves fingers 72 of main body 40 through acruate cam housing slots 76 of sealing sleeve 42. In turn, this will move lower locking ring actuation members 81 of main body 40 from abutment with fingers 80 of lower locking ring 46 into alignment with slots 84 of second or lower locking ring 46. Arcuate cam housing slots 76 of sealing sleeve 42 have double the width compared to the width of the cam profile of fingers 72 of main body 40 (FIG. 9) to allow this rotation of 12°.

Figure 13:
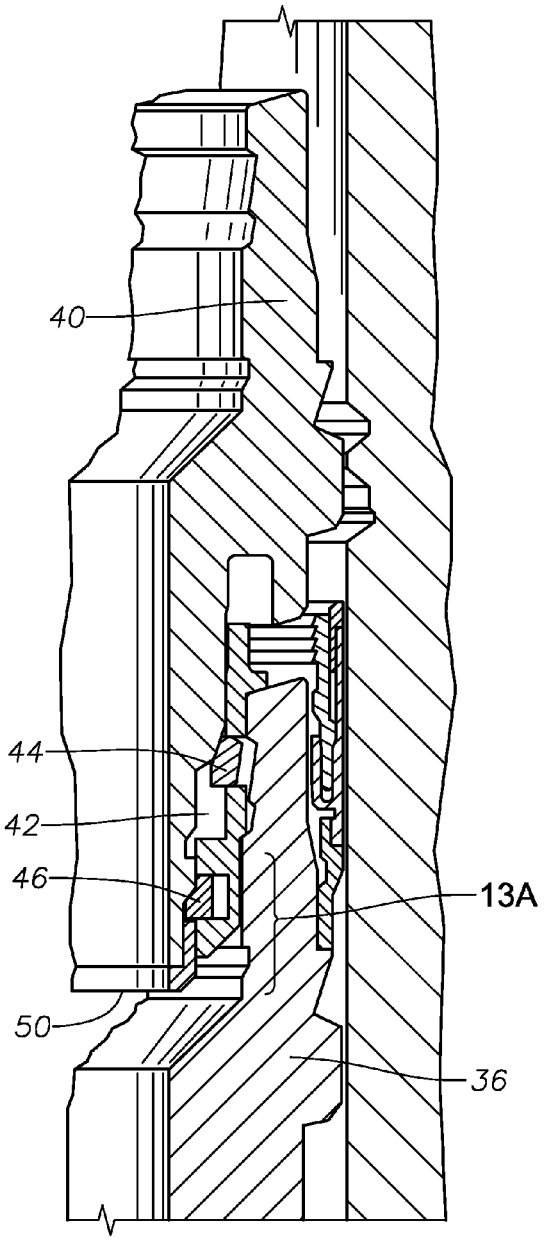
FIG. 13 is a schematic sectional view of portions of the structure of FIG. 1 illustrating the operation of the present invention.
Figure 13A:
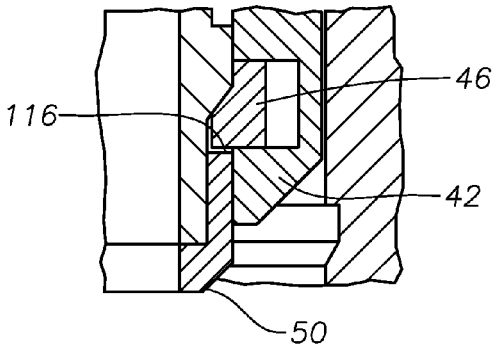
FIG. 13A is an enlarged view of a portion of the structure circled and identified by reference numeral 13A in FIG. 13.
Figure 14:
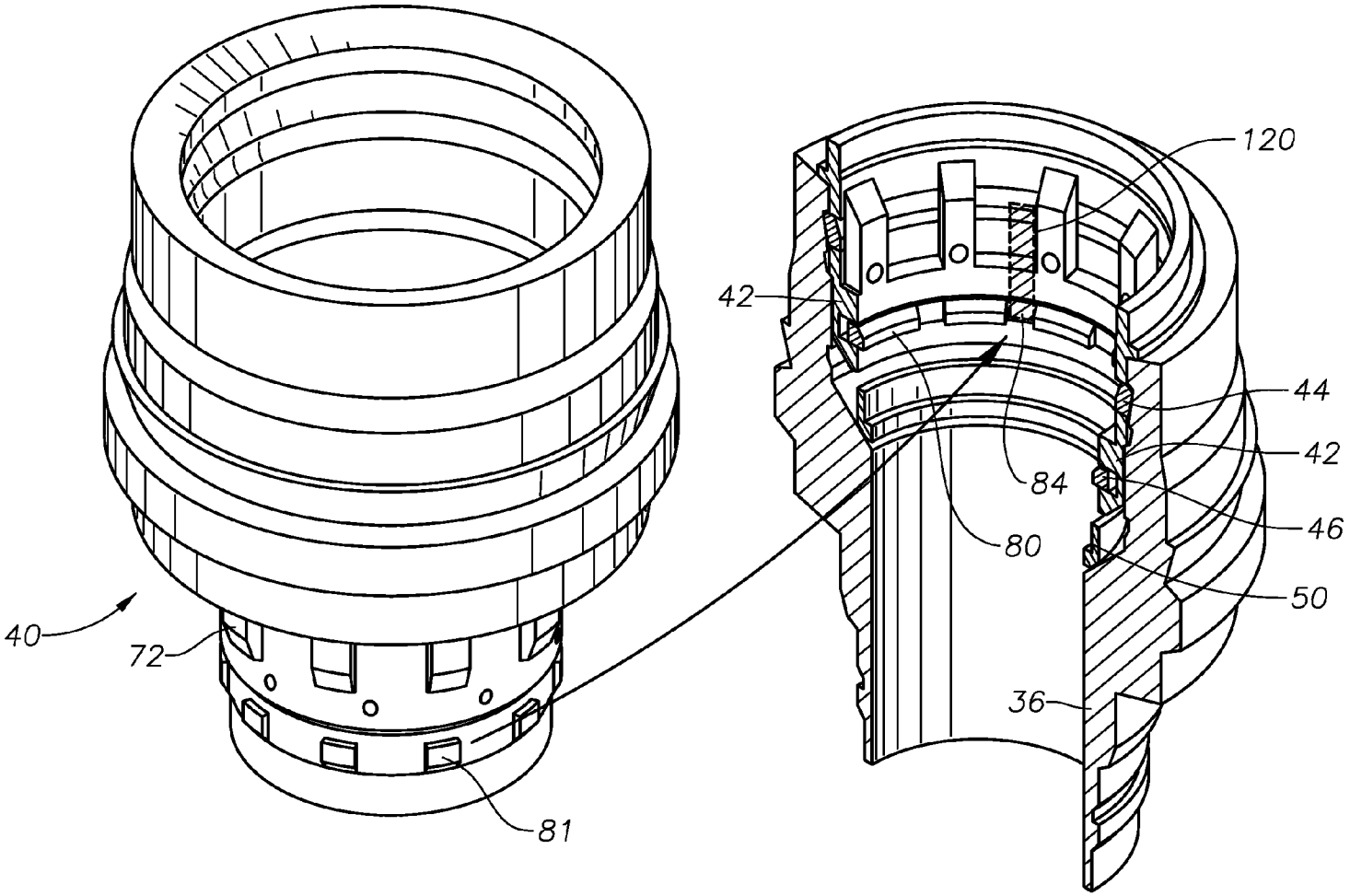
FIG. 14 is a sectional view of portions of the structure of FIG. 1 illustrating schematically the operation of the present invention.

When fingers 72 on main body 40 move to an opposite side of their respective cam housing slots 76 (FIG. 9), fingers 72 and lower locking ring actuation members 81 on main body 40 align as indicated schematically at 120 in FIG. 14 with slots 84 between fingers 80 in lower locking ring 46. Lower locking ring actuation members 81 of main body 40 are then capable of longitudinal movement with respect to sealing sleeve 42, unlocking main body 40 from sealing sleeve 42 through an upward axial movement from the position shown in FIG. 12A to the position shown in FIG. 13A. At the end of this movement, an upper surface 116 (FIG. 13A) of assembly nut 50 lands under the inwardly extending portions of fingers 80 of second or lower locking ring 46, providing lifting support through main body 40. Main body 40 can then be moved upwardly and sealing sleeve 42 which is now supported by main body 40 may be taken out of casing hanger 36.

For emergency procedures and in order to guarantee unlocking, main body 40, sealing sleeve 42, and casing hanger 36 are normally constrained not only axially but also rotationally due to the effect of the metal-to-metal seals. Usually, the strength of internal metal-to-metal seal 114 (FIG. 12A) between main body 40 against sealing sleeve 42 is less than the external connective forces indicated at 100 and 102 (FIG. 11A) between sealing sleeve 42 and casing hanger 36. Therefore, rotational movement which occurs during the normal unlocking process described above takes place between main body 40 and sealing sleeve 42.

Figure 15:
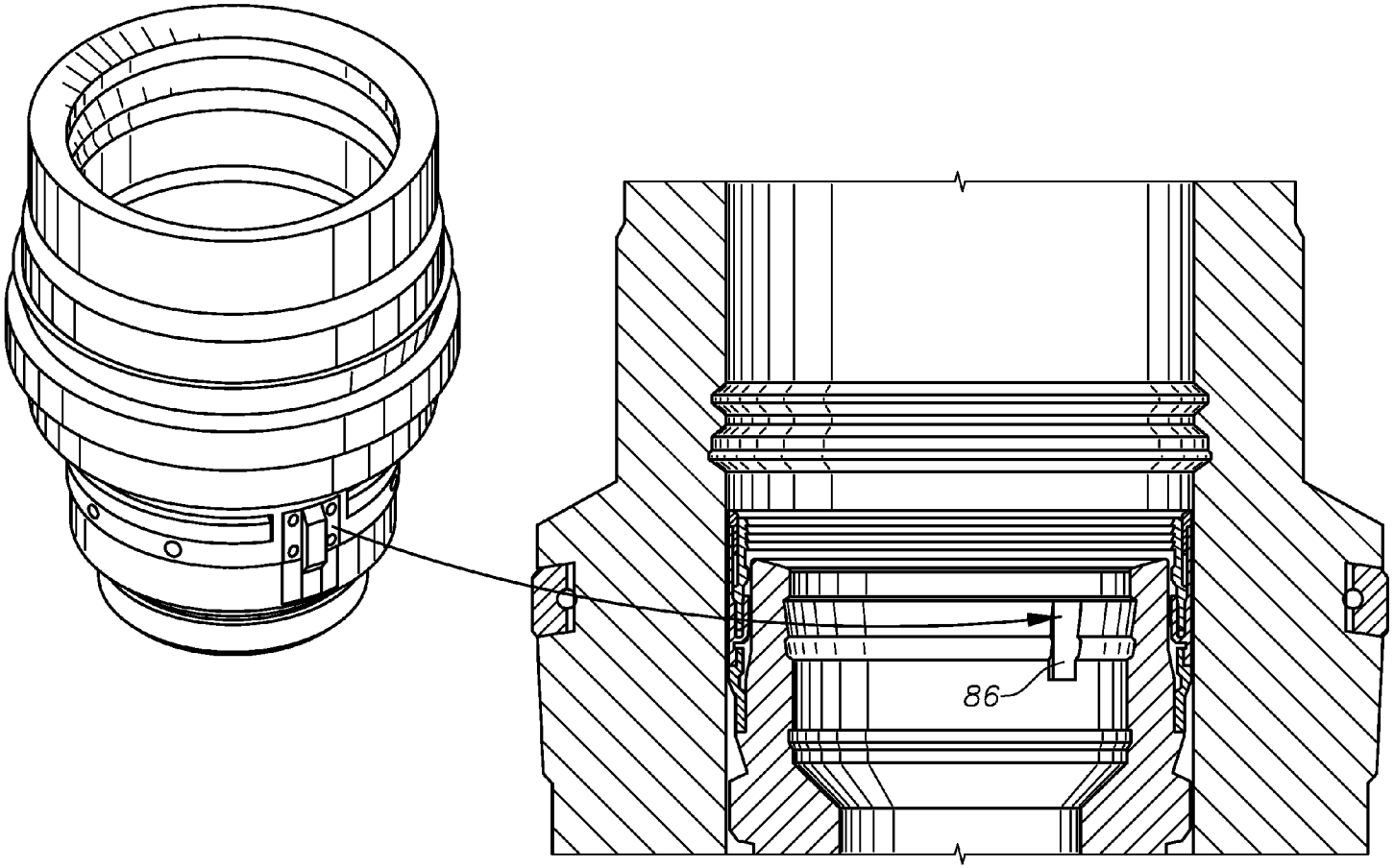
FIG. 15 is a sectional view of portions of the structure of FIG. 1 illustrating schematically the operation of the present invention.

However, should rotation occur between sealing sleeve 42 and casing hanger 36, the installed anchoring mechanism M might not unlock. In such an event, sealing sleeve 42 is, however, rotated within casing hanger 36 to a position where external anti-rotation key 68 is urged outwardly by resilient forces. External anti-rotation key 68 on outward movement is fitted in and engaged with one of the slots 86 formed in casing hanger 36 (FIG. 15). Sealing sleeve 42 and casing hanger 36 are then interconnected for common rotational movement. Rotational movement which then is imparted to main body 40 causes rotation to take place between main body 40 and casing hanger 36. Anchoring mechanism M can then be unlocked and separated from casing hanger 36 and wellhead housing 32.

Accordingly, the disclosed embodiments provide numerous advantages. For example, the pressure capacity of a bridging hanger may be increased with the disclosed embodiments by engaging the bridging hanger with the casing hanger to pull additional load capacity from the casing hanger and the suspended casing string. This is accomplished without the need for a separate lock down sleeve or hanger that would require an additional two trips downhole to land and set. Thus, the current embodiments reduce the total number of trips necessary to increase the pressure capacity of the bridging hanger to a level needed within the wellbore.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A bridging hanger for securing to a subsea casing hanger comprising:

a tubular main body;

a tubular sealing sleeve coaxial with and mounted on an exterior diameter portion of the tubular main body, the body being moveable from an upper run-in position to a lower set position relative to the sealing sleeve;

an inner metal sealing surface on an inner portion of the sealing sleeve that form a metal-to-metal seal between the body and the sealing sleeve in response to the body moving to the set position;

an outer metal sealing surface on an outer portion of the sealing sleeve that forms a metal-to-metal seal between the sealing sleeve and the casing hanger in response to the body moving to the set position;

a first locking ring carried by the sealing sleeve and adapted to engage a profile within an interior of the casing hanger in response to movement of the main body relative to the first locking ring from the run-in to the set position; and a second locking ring carried by the sealing sleeve to lock the tubular main body in the set position in response to movement of the main body relative to the second locking ring from the run-in to the set position.

2. The apparatus of claim 1, further comprising a cylindrical assembly nut mounted to an end of the main body axially below the sealing sleeve and having a threaded inner surface that mates with a corresponding threaded outer surface of the main body to retain the sealing sleeve on the main body.

3. The apparatus of claim 1, wherein the second locking ring comprises:

a C-ring mounted in an annular groove defined by an interior diameter lower portion of the sealing sleeve;

at least one radially spaced inwardly extending locking finger formed in the inner diameter surface of the C-ring; and the locking fingers adapted to fit into an annular recess formed about an exterior diameter portion of the main body, thereby forming a load bearing connection.

4. The apparatus of claim 1, wherein the first locking ring comprises:

a C-ring mounted in a circular recess defined by an exterior diameter upper portion of the sealing sleeve; and the C-ring having a cam profile configured to engage a mating profile of the main body so that the main body will urge the C-ring outwardly to engage the casing hanger when in the set position.

5. The apparatus of claim 1, wherein the tubular sealing sleeve is mounted to the main body by a shear pin extending through a hole in the sealing sleeve and into a corresponding hole in the main body to retain the main body in the run-in position until weight applied to the main body shears the shear pin.

6. The apparatus of claim 1, further comprising a plurality of fingers formed in the exterior surface of the main body proximate to corresponding finger slots formed in the interior surface of the sealing sleeve, the fingers and slots circumferentially placed around the diameter of the main body, and the finger slots having an arcuate width twice that of the fingers so that the fingers may insert into the finger slots and rotate from a first position to a second position to move the bridging hanger from the set to a retrieval position.

7. The apparatus of claim 1, further comprising:

a first cam surface on the body in engagement with the first locking ring;

a second cam surface on the body in engagement with the second locking ring; and wherein the movement of the body to the set position causes the first and second cam surfaces to simultaneously move the first and second locking rings into locking engagement with the casing hanger and the body, respectively, and to simultaneously move the inner and outer metal sealing surfaces into sealing engagement with the body and the casing hanger.

8. The apparatus of claim 1, further comprising:

a downward facing shoulder on the sealing sleeve adapted to land on a rim of the casing hanger while the body is in the run-in position.

9. A bridging hanger for securing to a subsea casing hanger comprising:

a tubular main body;

a tubular sealing sleeve coaxial with and mounted on an exterior diameter portion of the tubular main body, the body being moveable from an upper run-in position to a lower set position relative to the sealing sleeve;

a first locking ring carried by the sealing sleeve and adapted to engage a profile within an interior of the casing hanger in response to movement of the main body from the run-in to the set position;

a second locking ring carried by the sealing sleeve to lock the tubular main body in the set position in response to movement of the main body from the run-in to the set position; and an internal anti-rotation key mounted to the sealing sleeve for engaging the sealing sleeve to prevent rotation of the sealing sleeve relative to the casing hanger.

10. The apparatus of claim 9, further comprising an external anti-rotation key mounted to the sealing sleeve for engaging the casing hanger so that the external anti-rotation key is urged outwardly by a spring force exerted by a spring internal to the internal anti-rotation key.

11. A subsea wellhead assembly comprising:

a casing hanger adapted to be landed and set in a wellhead, the casing hanger having a locking profile;

a bridging hanger landed and set in the wellhead in engagement with the casing hanger, the bridging hanger having a tubular main body with a seal surface and a locking profile;

a tubular sealing sleeve carried by the body for landing on a rim of the casing hanger, the body being downwardly movable relative to the sleeve from a run-in position to a set position after the sealing sleeve lands on the rim of the casing hanger;

a first locking ring carried by the sealing sleeve that is expanded into engagement with the locking profile of the casing hanger in response to the downward movement of the body from the run-in to the set position, thereby locking the sealing sleeve to the casing hanger;

a second locking ring carried by the sealing sleeve that is contracted into engagement with the locking profile of the body response to downward movement of the body from the run-in to the set position, thereby locking the sealing sleeve to the body; and an inner seal surface on the sealing sleeve that sealingly engages the seal surface of the body in response to the downward movement of the body from the run-in to the set position.

12. The wellhead assembly of claim 11, further comprising:

an outer seal surface on the sealing sleeve that sealingly engages a seal surface on the casing hanger prior to the downward movement of the body from the run-in to the set position.

13. The wellhead assembly of claim 11, wherein the second locking ring comprises:

a C-ring mounted in an annular groove defined by an interior diameter lower portion of the sealing sleeve;

at least one radially spaced inwardly extending locking finger formed in the inner diameter surface of the C-ring; and wherein the locking fingers fit into an annular recess formed about an exterior diameter portion of the main body.

14. The wellhead assembly of claim 11, wherein the first locking ring comprises:

a C-ring mounted in a circular recess defined by an exterior diameter upper portion of the sealing sleeve; and the C-ring having a cam profile configured to engage a mating profile of the main body so that the main body will urge the C-ring outwardly to engage the casing hanger when in the set position.

15. The wellhead assembly of claim 11, wherein the tubular sealing sleeve is mounted to the main body by a shear pin extending through a hole in the sealing sleeve and into a corresponding hole in the main body to retain the main body in the run-in position until weight applied to the main body shears the shear pin.

16. The wellhead assembly of claim 11, further comprising a plurality of fingers formed in the exterior surface of the main body proximate to corresponding finger slots formed in the interior surface of the sealing sleeve, the fingers and slots circumferentially placed around the diameter of the main body, and the finger slots having an arcuate width twice that of the fingers so that the fingers may insert into the finger slots and rotate from a first position to a second position to move the bridging hanger from the set to a retrieval position.

17. The wellhead assembly of claim 11, further comprising:

a downward facing and outward extending shoulder on the sealing sleeve that lands on the rim of the casing hanger while the body is in the run-in position.

* * * * *